US012426674B2

(12) United States Patent
Bernhard et al.

(10) Patent No.: US 12,426,674 B2
(45) Date of Patent: Sep. 30, 2025

(54) RUNNING SHOE SOLE HAVING CHANNEL DAMPING

(71) Applicant: ON CLOUDS GMBH, Zurich (CH)

(72) Inventors: Olivier Bernhard, Heiden (CH); Ilmarin Heitz, Zurich (CH)

(73) Assignee: ON CLOUDS GMBH, Zurich (CH)

( * ) Notice: Subject to any disclaimer, the term of this patent is extended or adjusted under 35 U.S.C. 154(b) by 205 days.

(21) Appl. No.: 17/297,301

(22) PCT Filed: Oct. 22, 2019

(86) PCT No.: PCT/EP2019/078671
§ 371 (c)(1),
(2) Date: May 26, 2021

(87) PCT Pub. No.: WO2020/108868
PCT Pub. Date: Jun. 4, 2020

(65) Prior Publication Data

US 2022/0031018 A1 Feb. 3, 2022

(30) Foreign Application Priority Data

Nov. 27, 2018 (CH) ..... 01463/18
Jun. 13, 2019 (CH) ..... 00802/19

(51) Int. Cl.
*A43B 13/18* (2006.01)
*A43B 5/06* (2022.01)
*A43B 13/12* (2006.01)

(52) U.S. Cl.
CPC ..... *A43B 13/181* (2013.01); *A43B 5/06* (2013.01); *A43B 13/125* (2013.01)

(58) Field of Classification Search
CPC ... A43B 13/181; A43B 13/186; A43B 13/125; A43B 13/187; A43B 13/188;
(Continued)

(56) References Cited

U.S. PATENT DOCUMENTS 4,236,326 A 12/1980 Inohara
4,506,461 A * 3/1985 Inohara ..... A43B 13/20 36/35 B
(Continued)

FOREIGN PATENT DOCUMENTS

CN 88 1 03110 A 12/1988
CN 101299940 A 11/2008
(Continued)

OTHER PUBLICATIONS

Fed. Inst. of Industrial Property, Brazil, Office Action for Brazilian Application No. BR112021010087-3, issued Sep. 7, 2022 (4 pages).
(Continued)

*Primary Examiner* — Haley A Smith
(74) *Attorney, Agent, or Firm* — Pauley Erickson & Swanson

(57) ABSTRACT

A sole for a running shoe having a soft-elastic midsole includes an underside coming at least partially into contact with the ground during running. The midsole includes a plurality of channels extending in the transverse direction (Q) arranged in a lateral area (LB) of the midsole in a horizontal plane. At least a portion of the channels is arranged in the forefoot area (VFB) and/or at least a portion of the channels is arranged in the midfoot area (MFB) and/or at least a portion of the channels is arranged in the heel area (FB) of the midsole. The channels are each delimited in the longitudinal direction (L) by a front wall and a rear wall and have an elongated shape in cross-section along the running direction. The channels are deformable vertically and/or horizontally in the longitudinal direction (L) until their closure under the action of forces occurring during running acting vertically and/or in the longitudinal direction (L).

16 Claims, 2 Drawing Sheets

(58) Field of Classification Search
CPC ..... A43B 13/141; A43B 5/06; A43B 3/0063; A43B 3/0057; A43B 3/0068
See application file for complete search history.

(56) References Cited

U.S. PATENT DOCUMENTS

| | | | | |
|---|---|---|---|---|
| 4,536,974 | A * | 8/1985 | Cohen | A43B 13/18 36/28 |
| 4,611,412 | A | 9/1986 | Cohen | |
| 5,822,886 | A | 10/1998 | Luthi et al. | |
| 6,305,100 | B1 * | 10/2001 | Komarnycky | A43B 7/08 36/35 B |
| 9,433,256 | B2 * | 9/2016 | Callahan | A43B 3/0057 |
| 9,986,786 | B2 * | 6/2018 | Wang | A43B 13/186 |
| 2004/0154189 | A1 | 8/2004 | Wang | |
| 2005/0252038 | A1 | 11/2005 | Braunschweiler | |
| 2008/0034615 | A1 | 2/2008 | Nishiwaki et al. | |
| 2008/0276494 | A1 | 11/2008 | Lacorazza et al. | |
| 2008/0289224 | A1 * | 11/2008 | Sink | A43B 13/181 36/114 |
| 2009/0064542 | A1 * | 3/2009 | Figueroa | A43B 13/187 36/7.4 |
| 2009/0211114 | A1 | 8/2009 | Ivester et al. | |
| 2011/0016746 | A1 * | 1/2011 | Callahan | A43B 13/187 36/28 |
| 2011/0016749 | A1 * | 1/2011 | Callahan | A43B 13/14 12/146 B |
| 2012/0167416 | A1 * | 7/2012 | Christensen | A43B 13/188 36/103 |
| 2014/0305008 | A1 | 10/2014 | Wang et al. | |
| 2015/0230549 | A1 * | 8/2015 | Bernhard | A43B 13/181 36/25 R |
| 2017/0318902 | A1 * | 11/2017 | Schiller | A43B 13/188 |
| 2023/0082535 | A1 * | 3/2023 | Vu | A43B 13/38 36/28 |

FOREIGN PATENT DOCUMENTS

| | | | |
|---|---|---|---|
| CN | 203789258 | U | 8/2014 |
| CN | 104095350 | A | 10/2014 |
| DE | 28 16 619 | A1 | 10/1979 |
| DE | 3832743 | A1 | 9/1988 |
| EP | 0299669 | A2 | 1/1989 |
| JP | 2004065978 | A | 3/2004 |
| RU | 2330593 | C2 | 8/2008 |
| RU | 2489069 | C2 | 8/2013 |
| WO | WO 2016/184920 | A1 | 11/2016 |

OTHER PUBLICATIONS

Fed. Inst. of Industrial Property, Moscow, English Language verson of Office Action, Application No. 2021114190/03(030120), Oct. 22, 2019 (06 pages).

Fed. Inst. of Industrial Property, Moscow, English language version of Search Report, Application No. 2021114190/03(030120) Oct. 22, 2019 (02 pages).

EPO (Riswijk, NL), English language version of the International Search Report, Form PCT/ISA/210, for International Application PCT/EP2019/078671, Jan. 2, 2020 (2 pages).

Chinese Patent Office (CNIPO), Bejing, P.R. China, Search Report for Chinese Application No. 201900799693, issued Mar. 30, 2022 (3 pages).

Japanese Patent Office, English language version of the Office Action for Japanese Application No. 2021-529783, issued Oct. 31, 2023 (06 pages).

New Zealand IP Office, "Patent Examination Report 2," for NZ Application No. 776602, in the English language, dated Sep. 13, 2024 (4pp.).

Israel Patent Office, English language version of the Office Action for Israel Application No. IL 283391, issued Nov. 12, 2025 (2 pages).

* cited by examiner

RUNNING SHOE SOLE HAVING CHANNEL DAMPING

CROSS REFERENCE TO RELATED APPLICATION

This application is a National Phase filing in the United States, under 35 USC § 371, of PCT International Patent Application PCT/EP2019/078671, filed on 22 Oct. 2019 which claims the priority of Swiss Patent Applications CH 01463/18, filed 27 Nov. 2018 and Swiss Patent Application CH 00802/19, filed 13 Jun. 2019.

These applications are hereby incorporated by reference herein in their entirety and is made a part hereof, including but not limited to those portions which specifically appear hereinafter.

BACKGROUND OF THE INVENTION

Field of the Invention

The invention relates to the field of footwear technology, in particular for sports and leisure shoes, and concerns a sole for a running shoe, as well as the use of a sole for the manufacture of a running shoe.

Discussion of Related Art

A large number of running shoes with different cushioning systems are known in the prior art. Sports and leisure shoes with soles that have a gel core in the heel area to ensure vertical cushioning during tread are widely used. Furthermore, improvements in vertical cushioning properties have been achieved by placing individual spring elements in the heel area between the outsole and insole.

While the above-mentioned soles improve the vertical cushioning properties of the shoes, they cannot provide satisfactory cushioning of the forces acting horizontally on the sole and the shoe. Forces with a large horizontal component occur more frequently, especially on descending routes, and due to a lack of sufficient cushioning they represent one of the main causes of frequently occurring knee and hip joint pain.

A sole of the applicant is known from WO 2016 184 920 which has downwardly projecting, laterally open, segmented and channel-shaped elements. Under the effect of the forces occurring during running, the channel-shaped elements are deformable both vertically and horizontally until their lateral openings are closed. Segmentation of the sole also segments the cushioning effect, forming non-cushioned or less cushioned areas in the sole.

SUMMARY OF THE INVENTION

In many sports activities, such as running, the initial contact of the shoe with the ground occurs in the heel area. As a result, the passive forces acting on the shoe are significantly greater in this area than in the forefoot or midfoot area of the sole. In this context, passive force refers to the force acting during tread, while active force, for example, refers to the force exerted by the wearer during push-off. To take this into account, running shoes generally feature particularly pronounced cushioning in the heel area. Although such a design allows at least sufficient vertical cushioning to be provided, the pronounced cushioning has a negative effect on the overall weight of the shoe. As a result, running shoes known in the prior art have either unsatisfactory cushioning and/or a high weight.

Another disadvantage of well-known running shoe soles is their low durability. Longer service life is often accompanied by a significant loss of cushioning effect. This is often caused by fatigue of the cushioning material.

It is therefore the general object of the invention to advance the prior art in the field of running shoes and preferably to overcome one or more disadvantages of the prior art. In advantageous embodiments, a sole with an improved cushioning effect is provided, which preferably has a low weight.

In further embodiments, a sole with a cushioning effect is provided, which has improved durability over a longer period of time.

The general problem of the invention is solved in a general way by the objects of the independent patent claims.

Further advantageous embodiments are apparent in each of the dependent patent claims, as well as in the disclosure as a whole.

The sole for a running shoe according to the invention comprises a soft-elastic midsole, which has an underside that comes at least partially into contact with the ground during running. The midsole further comprises a plurality of channels extending in the transverse direction, which are arranged in a lateral area of the midsole in a horizontal plane. At least some of the channels (3*a*, 3*b*) are arranged in the forefoot area (VFB) and/or at least some of the channels are arranged in the midfoot area (MFB) and/or at least some of the channels are arranged in the heel area (FB) of the midsole. The channels are each delimited in the running direction by a front wall and a rear wall and each have an elongated shape in cross section along the running direction. Under the effect of forces acting vertically and/or in the longitudinal direction during running, the channels can be deformed vertically and/or horizontally in the longitudinal direction until they are closed. Due to the elongated shape of the channels in cross-section in the longitudinal direction, in contrast to channels without such an elongated shape, e.g., a circular or square cross-section, a significantly improved cushioning effect is achieved without a feeling of floating due to a substantial loss of stability caused by the channels. In a running shoe sole according to the invention, the channel cushioning of the midsole cooperates with the material-induced cushioning of the soft-elastic midsole. Due to the elongated shape of the channels, the cushioning effects are optimally matched with each other. Compared to other cushioning systems, such as gel pads, the channels offer the advantage that the weight of the running shoe can be significantly reduced.

Directional indications as used in the present disclosure are to be understood as follows: A horizontal plane of the sole describes a plane which is oriented substantially parallel to the underside of the sole, respectively substantially parallel to the ground. It is also understood that the horizontal plane may also be slightly curved. This may be the case, for example, if the sole is slightly curved upwards vertically at the forefoot area and/or at the heel area, as is typical in running shoes. The longitudinal direction L of the sole is described by an axis from the heel area to the forefoot area and thus extends along the longitudinal axis of the sole. The transverse direction Q of the sole extends transversely to the longitudinal axis and substantially parallel to the underside of the sole, respectively substantially parallel to the ground. Thus, the transverse direction runs along a transverse axis of the midsole. In the context of the present invention, the vertical direction V denotes a direction from the underside of the sole towards the insole, or in the operative state towards the foot of the wearer, and thus runs along a vertical axis of the midsole.

Further, the lateral area of the midsole refers to an area along the lateral inner and outer sides of the midsole of the running shoe of a pair of running shoes, wherein the area extends in the direction of the longitudinal axis of the midsole. Typically, the horizontal extension of the lateral area is a few centimeters, for example 0.1 to 5 cm, preferably 0.5 to 3 cm. The medial area of the midsole refers to an area along the longitudinal axis at the center of the midsole, which extends in each case in the transverse direction of the midsole. Typically, the horizontal extension of the medial area is a few centimeters, for example 0.1 to 5 cm, preferably 0.5 to 3 cm. The skilled person understands that the horizontal extension of the lateral area and the medial area may vary depending on the respective shoe size.

For the purposes of the present invention, a channel is a recess which can typically be tubular in shape. In this context, the channels run in the transverse direction of the sole, i.e., are arranged essentially transverse to the running direction, and are arranged parallel to the running surface, respectively parallel to the ground. Generally, a channel is wholly or partially delimited by channel walls. Typically, the channels are empty. However, it is also possible that in some embodiments the channels are filled, for example with an elastically deformable foam material or with a gas.

According to the present invention, the channels are each delimited by a front wall and a rear wall. In addition, the channels may have a top wall and a bottom wall. A wall may be formed by a flat surface, or in particular front and rear walls may be formed by two or more surfaces which form one or more folding edges. The term "folding edge" also includes embodiments which are slightly rounded and therefore not completely angular. Such a folding edge consequently runs along the channel and thus in the transverse direction of the midsole and essentially transverse to the running direction.

It is clear to the person skilled in the art that channel deformability may include, for example, vertically bringing together the channel walls and/or longitudinal shearability of the channel.

In addition, the phrase "underside coming into contact with the ground when running" also includes embodiments in which the midsole is coated with a further lower layer, for example a full-surface or segmented outsole. In such cases, contact with the ground is at least partially established by means of such an outsole.

The elongated shape of the channels in the transverse direction can have an angular or oval cross-section, for example.

Preferably, the midsole has a plurality of channels, particularly at least 3, at least 4, at least 5, at least 6, at least 7, or at least 8 channels.

In preferred embodiments, the channels have lateral openings in the lateral area of the midsole. Preferably, the channels are deformable vertically and/or horizontally in the longitudinal direction under the action of forces acting vertically and/or in the longitudinal direction and occurring during running until the lateral openings are closed.

Typically, the upper and lower channel walls can contact each other under the effect of the forces that occur during running.

In further embodiments, at least a portion of the channels is disposed in the heel area and additionally a portion of the channels is disposed in the forefoot area and/or a portion of the channels is disposed in the midfoot area of the midsole. Preferably, at least a portion of the channels is arranged in the forefoot area, a portion of the channels is arranged in the midfoot area, and a portion of the channels is arranged in the heel area of the midsole. Thus, in such embodiments, at least one channel is arranged in each of the heel area, the midfoot area, and the forefoot area. Since part of the channels are arranged in the forefoot area, part in the midfoot area and part in the heel area of the midsole, the channels are preferably distributed substantially over the entire midsole. Hereby, the weight of the sole can be reduced due to the recesses. In addition, it has been shown that it is advantageous for the running feeling, in particular, for the cushioning effect, if channels are arranged not only in the heel and midfoot area, but also in the forefoot area.

In some embodiments, the channels are completely delimited by the midsole, at least in the lateral area, thereby optimizing the overall cushioning effect consisting of the cushioning effect of the soft-elastic material of the midsole and the effect of the channels.

In some embodiments, at least a portion of the channels are disposed in the heel area and at least a portion of the channels are disposed in the forefoot area. The channels in the heel area have a greater channel height than the channels in the forefoot area. The passive forces that occur during running and need to be cushioned are typically greatest during running upon tread with the heel, so that a selective increase in the cushioning effect by increasing the channel height is advantageous in this area. The channel height is defined as the greatest vertical distance between the channel delimitations, in particular the channel walls, within a channel.

In further embodiments, the channels are arranged in the heel area and/or in the forefoot area and/or in the midfoot area of a single horizontal plane. Thus, in such embodiments, all the channels of the sole lie in a single horizontal plane, at least in the lateral area.

In some embodiments, the channels have a substantially hexagonal and/or pentagonal cross-section. Typically, at least one corner of the penta- or hexagon is in this case arranged in the longitudinal direction, i.e., in or opposite to the running direction. For example, one corner of the penta- or hexagon may be arranged in the running direction towards the tip of the sole or opposite to the running direction towards the end of the sole. In addition, the penta- or hexagon can comprise an asymmetry, for example, the sides of the penta- or hexagon in the running direction, i.e., sides which extend essentially parallel to the ground, can be longer than the other sides of the penta- or hexagon. This gives the channels amongst others in cross-section the elongated shape according to the invention.

Particularly preferably, the channels comprise two sides in cross-section that are essentially parallel to each other and to the bottom, respectively to the underside. These sides correspond to the top and bottom walls of the channel. The angular shape of the channels in cross-section has positive effects on the deformability of the channels. Thus, the hexagonal shape is preferentially suitable for improving the deformability of the channels. Consequently, the deformability of each channel can be individually and flexibly adapted to its position and the specific forces acting on the channel, due to the correct shape of the channels.

In further embodiments, the front wall and the rear wall of at least one channel each has a front folding edge and a rear folding edge. The front and rear folding edges are arranged in the running direction in the direction of the tip of the sole, and in the opposite direction to the running direction in the direction of the heel edge of the sole, respectively.

In some embodiments, the ratio of the channel height to the channel width in the lateral area of the midsole of each channel is in the range of 0.15 to 0.6, preferably 0.2 to 0.4. The channel width is defined by the largest horizontal distance of the channel delimitation within a channel.

Preferably, the ratio of channel height to channel width in the lateral area of the midsole of each channel is greater in the heel area than in the forefoot area. For example, the ratio in the heel area can be 0.35 to 0.4 and the ratio in the forefoot area can be 0.2 to 0.3.

In some embodiments, in the heel area, the channel width of each channel in the lateral area, particularly in the area of the lateral openings, may be 15 to 20 mm and the channel height of each channel in the lateral area, particularly in the area of the lateral openings, may be 5 to 10 mm.

In further embodiments, in the forefoot area, the channel width of each channel in the lateral area, in particular in the area of the lateral openings, may be 9 to 16 mm, in particular 10 to 14 mm, and the channel height of each channel in the lateral area, in particular in the area of the lateral openings, may be 1 to 5 mm, in particular 2 to 4 mm. The skilled person understands that the channel height and the channel width may vary depending on the shoe size.

In some embodiments, the channels each taper from the lateral area of the midsole to the medial area of the midsole. For example, the cross-section, respectively the cross-sectional area, of each channel in the medial area may be 8 to 20% smaller than in the lateral area, particularly than in the area of the lateral openings. Thus, each channel has a greater width and/or height in the lateral area than in the medial area. In particular, the ratio of the channel height to the channel width of each channel can be greater in the lateral area than in the medial area of the respective channel.

In further embodiments, the channels are fully compressible when running starting from a force of 1000 N to 3000 N, preferably 1500 N to 2000 N.

In some embodiments, the sole comprises an incompressible elastic plate that preferably extends over the entire midsole. Such a plate may extend over the heel area, midfoot area and forefoot area. Typically, the plate is a continuous plate, which thus has no recesses. The plate can be arranged in the vertical direction above the soft-elastic midsole and thus cover it at least partially or completely.

In further embodiments, at least a portion of the channels, preferably the channels in the forefoot area, in a medial area of the midsole is delimited on one side by the elastic incompressible plate. Since the required cushioning effect is significantly lower in the forefoot area than in the heel area and midfoot area, the overall weight can be reduced in such embodiments by reducing midsole material without any significant degradation of the cushioning effect. In general, the elastic incompressible plate has the advantage of assisting the push-off process during running, since the plate is stretched during running and returns to its original shape during the push-off process. Thus, the runner has to apply less force per push-off process than without the elastic incompressible plate.

In some embodiments, the midsole has a groove extending in the longitudinal direction from the heel area to at least the midfoot area. The groove may have a depth of 1 cm to 3 cm, preferably 1.8 to 2.5 cm. The skilled person understands that the depth of the groove may vary depending on the respective shoe size. In cross-section in the transverse direction of the sole, the channel may be V-shaped. Preferably, the cross-section has a step, with the angle between the running surface and the groove being between 40 and 60° in the area of the running surface and 75 to 90° at the step. This can prevent the jamming of stones in the channel. In general, the groove has the advantage of allowing substantial reduction in the material of the midsole, which come substantially without any deterioration in stability. For example, the width of the groove may be 2 to 3 cm in the running area and narrow in the vertical direction to 0.5 to 1.5 cm, preferably 0.7 to 0.9 cm. The skilled person understands that the width of the groove may vary depending on the shoe size.

In embodiments with an elastic incompressible plate, the groove may be directly delimited by the plate. Thus, the incompressible elastic plate is directly exposed to the environment at least in the area of the groove.

Another aspect of the invention relates to a running shoe comprising a sole according to any of the embodiments described herein.

Another aspect of the invention relates to the use of a sole according to any of the embodiments described herein for the manufacture of a running shoe.

BRIEF DESCRIPTION OF SEVERAL VIEWS OF THE DRAWINGS

Aspects of the invention are explained in more detail on the basis of the specific embodiment examples shown in the following figures and the associated description. The embodiments shown in the figures are not to be understood as limiting the invention described in the claims.

DETAILED DESCRIPTION OF THE INVENTION

Figure 1:
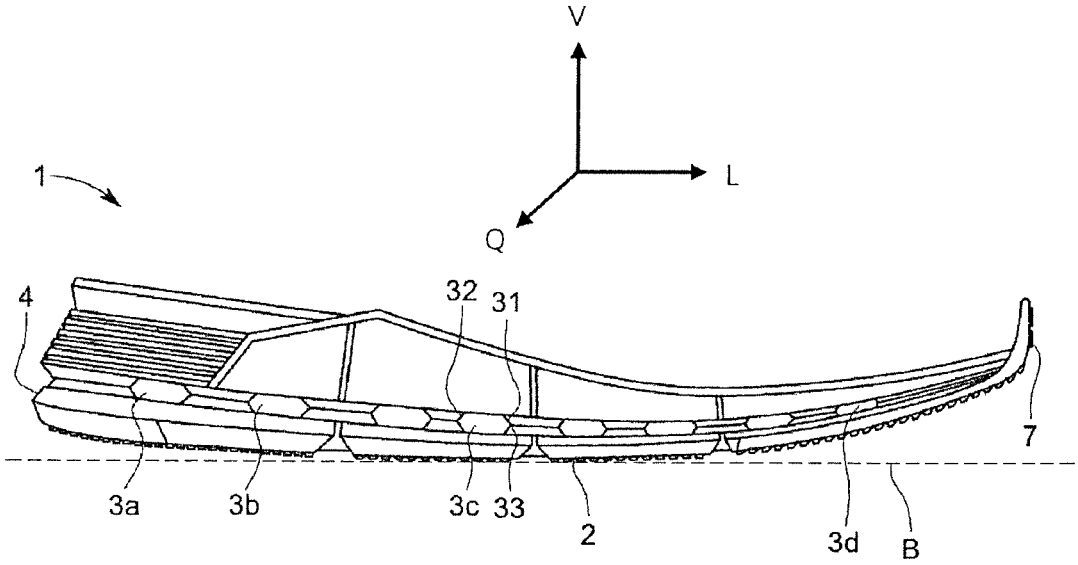
FIG. 1 shows a schematic side view of a sole for a running shoe according to one embodiment of the invention.

The schematic side view shown in FIG. 1 shows an embodiment of a sole for a running shoe with a soft-elastic midsole 1. The soft-elastic midsole is shown in a view on the outside and comprises an underside 2 which comes into contact with the ground B shown as a dashed line during running. Furthermore, the midsole 1 comprises eight channels 3*a*, 3*b*, 3*c* and 3*d* running in the transverse direction Q in a lateral area of the midsole (for better clarity, not all channels of the sole according to the invention shown are designated). FIG. 1 shows the lateral area of the midsole in a side view. As shown, the channels 3*a*, 3*b*, 3*c* and 3*d* are arranged in a single horizontal plane. Since the sole is in the vertical direction V bent slightly upwards at the sole tip 7, the first horizontal plane has a slight curvature, in the present case a convex curvature as seen from the ground. On the basis of the coordinate system, it is clear that the horizontal plane lies essentially, i.e., disregarding the slightly vertical curvature of the midsole, in the plane of the transverse direction Q and of the longitudinal direction L of the midsole. In the embodiment shown, the channels extend along the entire length of the soft-elastic midsole. Thus, a first portion of the channels 3*a*, 3*b* is located in the heel area, a second portion of the channels 3*c* is located in the midfoot area, and a third portion of the channels 3*d* is located in the forefoot area.

The channels 3*a*, 3*b*, 3*c* and 3*d* each comprise a lateral opening in the lateral area of the midsole 1. In the operative state, the openings can be deformed to the point of closure by the forces occurring during running. Closure can occur in this case in essentially by vertical deformation and/or also by horizontal deformation in the longitudinal direction, i.e., by shearing of the channels. Moreover, the channels 3*a*, 3*b*, 3*c* and 3*d* are completely delimited in the lateral area of the midsole 1 by the soft-elastic midsole 1. Thus, all of the channel walls in the lateral area are formed by the soft-elastic midsole. Each of the channels 3*a*, 3*b*, 3*c* and 3*d* has a front wall 31 and a rear wall 32. In addition, the channels are hexagonal in cross-section in the lateral area of the soft-elastic midsole 1. Thereby, one corner of the hexagon points in the longitudinal direction in the running direction and one corner points in the longitudinal direction opposite to the running direction. The respective hexagon is formed asymmetrically, since the sides of the hexagon in the longitudinal direction are formed longer than the other sides of the hexagon. Therefore, the respective channel has an elongated and flat shape. In addition, both the front wall 31 and the rear wall 32 of the channels each have a folding edge 33. In cross-section, these folding edges correspond to the corners of the hexagon arranged in the running direction towards the sole tip 7 and against the running direction towards the heel edge 4.

Figure 2:
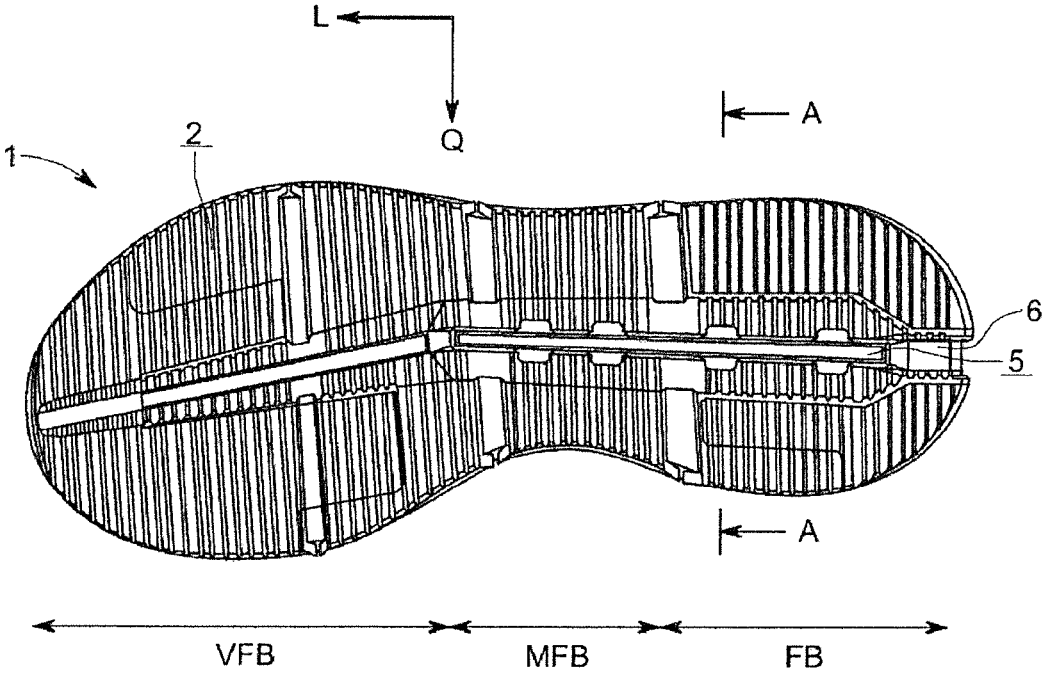
FIG. 2 shows a view of the underside of the sole shown in FIG. 1, with the sole shown in the opposite direction.

FIG. 2 shows a view on the underside 2 of a midsole 1 according to one embodiment of the invention. In addition, a division of the midsole into a forefoot area VFB, a midfoot area MFB and a heel area FB is shown. This serves merely as a guideline for the person skilled in the art and is not intended to define the exact boundaries of the areas. The midsole 1 shown has a groove 6 extending from the heel area into the midfoot area. The groove is open towards the ground B, i.e. towards the viewer in the illustrated view of FIG. 2, and is delimited at the lateral flanks by the soft-elastic midsole 1 and at the base by an elastic incompressible plate 5. It can also be seen that the lateral flanks are inclined so that the groove 6 is open towards the viewer in a substantially V-shape. In the embodiment shown, the groove 6 extends through the entire midsole 1, i.e., from the heel area FB through the midfoot area MFB to the forefoot area VFB.

Figure 3:
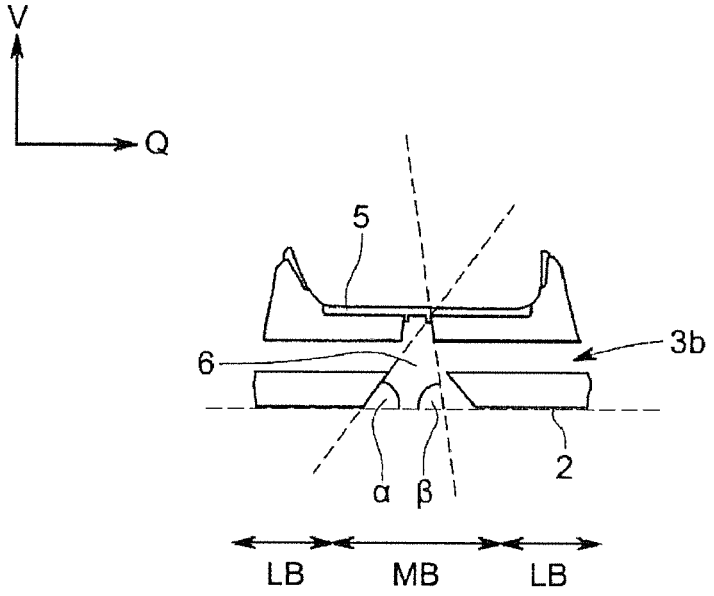
FIG. 3 shows a schematic section in transverse direction (along AA according to FIG. 2) according to a further embodiment of the invention.

FIG. 3 shows a further embodiment of a sole according to the invention for a running shoe with a soft-elastic midsole 1. FIG. 3 also shows a schematic division of the midsole into the lateral area LB and the medial area MB. These areas extend in the transverse and longitudinal directions as well as in the vertical direction. However, the arrows shown do not define precise area boundaries. FIG. 3 is a cross-section of the midsole 1 through the channel 3*b* of the first horizontal plane, which is completely delimited in the lateral area by the soft-elastic midsole 1. The sole includes the elastic incompressible plate 5, which delimits the groove 6 in the medial area and is exposed to the environment in the medial area. Furthermore, FIG. 3 shows that the channel is funnel-shaped in cross-section in the transverse direction and has a step. The first angle $\alpha$ between the underside 2 and the groove in the area of the underside, or running surface, is about 55°. At the step, the second angle $\beta$ between the underside 2 and the upper delimitation of the channel is about 85°.

The invention claimed is:

1. A sole for a running shoe with a soft-elastic midsole (1), comprising:

an underside (2) coming at least partially into contact with the ground during running, wherein the midsole (1) comprises a plurality of channels (3*a*, 3*b*, 3*c* and 3*d*) running in a transverse direction (Q), wherein the channels (3*a*, 3*b*, 3*c* and 3*d*) are arranged in a lateral area (LB) of the midsole (1) in a horizontal plane, and wherein at least a portion of the channels (3*a*, 3*b*) is arranged in a forefoot area (VFB) and/or a portion of the channels is arranged in a midfoot area (MFB) and/or a portion of the channels is arranged in a heel area (FB) of the midsole (1), wherein the channels (3*a*, 3*b*, 3*c* and 3*d*) are at least in the lateral area (LB) completely delimited by the midsole (1), and wherein the channels (3*a*, 3*b*, 3*c* and 3*d*) are each delimited in a longitudinal direction (L) by a front wall (31) and a rear wall (32), wherein the front wall (31) and the rear wall (32) of at least one channel (3*a*, 3*b*, 3*c*, and 3*d*) each comprise a front folding edge and a rear folding edge (33), and wherein in the lateral area the midsole extends continuously between the front wall and the rear wall from a top to a bottom of each adjacent channel, and wherein the channels (3*a*, 3*b*, 3*c* and 3*d*) have an elongated shape in cross-section along the running direction and have at least one of a substantially hexagonal and pentagonal cross-section, and the channels (3*a*, 3*b*, 3*c* and 3*d*) are deformable vertically and/or horizontally in the longitudinal direction (L) until closure under an action of forces occurring during running, acting vertically and/or in the longitudinal direction.

2. The sole according to claim 1, wherein the channels (3*a*, 3*b*, 3*c* and 3*d*) comprise lateral openings in the lateral area (LB) of the midsole (1).

3. The sole according to claim 2, wherein the channels (3*a*, 3*b*, 3*c* and 3*d*) are deformable vertically and/or horizontally in the longitudinal direction (L) under the action of forces occurring during running acting vertically and/or in the longitudinal direction (L) until the lateral openings are closed.

4. The sole according to claim 1, wherein a portion of the channels (3*d*) is arranged in the heel area and at least a portion of the channels is arranged in the forefoot area (VFB) and/or a portion of the channels (3*c*) is arranged in the midfoot area (MFB).

5. The sole according to claim 4, wherein the channels (3*a*, 3*b*) in the heel area (FB) have a greater channel height than the channels (3*d*) in the forefoot area (VFB).

6. The sole according to claim 1, wherein a portion of the channels (3*a*, 3*b*, 3*c* and 3*d*) is arranged in the heel area (FB) and wherein the channels in the forefoot area (VFB) and/or in the midfoot area (MFB) are arranged in a single horizontal plane.

7. The sole according to claim 1, wherein the ratio of the channel height to the channel width of each channel (3*a*, 3*b*, 3*c* and 3*d*) is in the range of 0.15 to 0.6.

8. The sole according to claim 1, wherein the channels (3*a*, 3*b*, 3*c* and 3*d*) are fully compressible during running starting with a force of 1000 N to 3000 N.

9. The sole according to claim 1, wherein the sole comprises an incompressible elastic plate (5).

10. The sole according to claim 9, wherein at least a portion of the channels (3*a*, 3*b*, 3*c* and 3*d*) in the midfoot area (MFB) of the midsole (2) is delimited on one side by the elastic incompressible plate (5).

11. The sole according to claim 9, wherein the incompressible elastic plate (5) extends over the entire midsole (1).

12. The sole according to claim 9, wherein the channels (3*d*) in the forefoot area (VFB) are delimited on one side by the elastic incompressible plate (5).

13. The sole according to claim 1, wherein the midsole (1) comprises a groove (6) extending in the longitudinal direction (L) from the heel area (FB) to at least the midfoot area (MFB).

14. The sole according to claim 1, wherein the ratio of the channel height to the channel width of each channel (3*a*, 3*b*, 3*c* and 3*d*) is in the range of 0.2 to 0.4.

15. The sole according to claim 1, wherein the channels (3*a*, 3*b*, 3*c* and 3*d*) are fully compressible during running starting with a force of 1500 N to 2000 N.

16. A running shoe comprising a sole according to claim 1.

* * * * *